US010718045B2

(12) United States Patent
Mutschler et al.

(10) Patent No.: US 10,718,045 B2
(45) Date of Patent: Jul. 21, 2020

(54) ZINC-COATED STEEL FOR PRESS HARDENING APPLICATIONS AND METHOD OF PRODUCTION

(71) Applicant: AK Steel Properties, Inc., West Chester, OH (US)

(72) Inventors: Ralph Mutschler, West Chester, OH (US); Grant Thomas, Liberty Township, OH (US); Paul V. Janavicius, Wyoming, OH (US); Luis G. Garza-Martinez, Wyoming, OH (US)

(73) Assignee: AK Steel Properties, Inc., West Chester, OH (US)

( * ) Notice: Subject to any disclaimer, the term of this patent is extended or adjusted under 35 U.S.C. 154(b) by 411 days.

(21) Appl. No.: 14/279,818

(22) Filed: May 16, 2014

(65) Prior Publication Data

US 2014/0342181 A1 Nov. 20, 2014

Related U.S. Application Data

(60) Provisional application No. 61/824,791, filed on May 17, 2013.

(51) Int. Cl.
*C23C 2/28* (2006.01)
*C21D 1/26* (2006.01)
(Continued)

(52) U.S. Cl.
CPC ..... *C23C 2/28* (2013.01); *B21D 22/00* (2013.01); *B21D 22/208* (2013.01); *C21D 1/26* (2013.01);
(Continued)

(58) Field of Classification Search
CPC .... C23C 2/26; C23C 2/28; C23C 2/06; C23C 2/285; C23C 2/04; C23C 2/02; C23C 2/40; C23C 2/12; C23C 2/36; Y10T 428/12799
See application file for complete search history.

(56) References Cited

U.S. PATENT DOCUMENTS 3,873,377 A * 3/1975 Fisher ..... C21D 1/76 148/601
4,264,684 A 4/1981 Allegra et al.
(Continued)

FOREIGN PATENT DOCUMENTS

DE 10 2012 021031 A1 5/2013
EP 1 630 244 B1 7/2009
(Continued)

OTHER PUBLICATIONS

Brown, W.N., et al., "A Study of the Kinetics of Interaction Between Fe(s) and Zn(1) in the Temperature Range 570-740° C.", Corrosion Science, 1965, col. 5, pp. 779-785.
(Continued)

*Primary Examiner* — Michael E. La Villa
(74) *Attorney, Agent, or Firm* — Frost Brown Todd LLC

(57) ABSTRACT

A zinc-coated steel may be produced by performing a pre-alloying heat treatment after galvannealing the steel and prior to the hot stamping the steel. The pre-alloying heat treatment is conducted at a temperature between about 850° F. and about 950° F. in an open coil annealing process. The pre-alloying heat treatment allows for shorter time at the austenitization temperature to form a desired α-Fe phase in the coating by increasing the concentration of iron. This also decreases the loss of zinc, and a more adherent oxide exists after hot stamping.

12 Claims, 8 Drawing Sheets

(51) Int. Cl.

| | |
|---|---|
| ***C21D 9/67*** | (2006.01) |
| ***C23C 2/06*** | (2006.01) |
| ***C21D 1/74*** | (2006.01) |
| ***C23C 2/40*** | (2006.01) |
| ***C21D 1/673*** | (2006.01) |
| ***C23C 2/02*** | (2006.01) |
| ***C23C 2/26*** | (2006.01) |
| ***C23C 2/04*** | (2006.01) |
| ***C23C 2/36*** | (2006.01) |
| ***C23C 2/12*** | (2006.01) |
| ***C21D 8/04*** | (2006.01) |
| ***B21D 22/00*** | (2006.01) |
| ***B21D 22/20*** | (2006.01) |
| ***C21D 8/02*** | (2006.01) |
| ***C21D 8/00*** | (2006.01) |
| *C21D 1/78* | (2006.01) |
| *B21D 22/02* | (2006.01) |

(52) U.S. Cl.

CPC ..... *C21D 1/673* (2013.01); *C21D 1/74* (2013.01); *C21D 8/005* (2013.01); *C21D 8/02* (2013.01); *C21D 8/0247* (2013.01); *C21D 8/04* (2013.01); *C21D 8/0405* (2013.01); *C21D 8/0457* (2013.01); *C21D 9/67* (2013.01); *C23C 2/02* (2013.01); *C23C 2/04* (2013.01); *C23C 2/06* (2013.01); *C23C 2/12* (2013.01); *C23C 2/26* (2013.01); *C23C 2/285* (2013.01); *C23C 2/36* (2013.01); *C23C 2/40* (2013.01); *B21D 22/022* (2013.01); *C21D 1/78* (2013.01); *Y10T 428/12799* (2015.01)

(56) References Cited

U.S. PATENT DOCUMENTS

| | | | | |
|---|---|---|---|---|
| 5,015,341 | A | 5/1991 | Guzzetta et al. | |
| 5,897,967 | A * | 4/1999 | Hori | C23C 2/06 148/320 |
| 6,524,725 | B1 | 2/2003 | Lips et al. | |
| 6,564,604 | B2 | 5/2003 | Kefferstein et al. | |
| 6,913,658 | B2 | 7/2005 | Delaunay et al. | |
| 7,399,535 | B2 | 7/2008 | Yoshikawa et al. | |
| 7,673,485 | B2 | 3/2010 | Imai et al. | |
| 8,021,497 | B2 | 9/2011 | Fleischanderl et al. | |
| 8,127,449 | B2 | 3/2012 | Bayer et al. | |
| 8,741,075 | B2 | 6/2014 | Imai et al. | |
| 9,040,166 | B2 | 5/2015 | Nakamaru et al. | |
| 2004/0033386 | A1 * | 2/2004 | Pradhan | B32B 15/013 428/659 |
| 2006/0121305 | A1 * | 6/2006 | Yoshikawa | C23C 2/26 428/629 |
| 2008/0072784 | A1 * | 3/2008 | Oohashi | C23C 2/06 106/1.18 |
| 2009/0025836 | A1 | 1/2009 | Bello et al. | |
| 2010/0282374 | A1 * | 11/2010 | Mataigne | C23C 2/28 148/533 |
| 2011/0076477 | A1 | 3/2011 | Brandstätter et al. | |
| 2011/0300407 | A1 | 12/2011 | Cho et al. | |
| 2011/0303328 | A1 | 12/2011 | Kondo et al. | |
| 2012/0073351 | A1 | 3/2012 | Maki et al. | |
| 2012/0085466 | A1 | 4/2012 | Lupp et al. | |
| 2012/0118437 | A1 | 5/2012 | Wang et al. | |
| 2012/0164472 | A1 | 6/2012 | Kuhn et al. | |
| 2012/0267012 | A1 | 10/2012 | Sohn et al. | |
| 2012/0291510 | A1 | 11/2012 | Kim et al. | |
| 2012/0325377 | A1 * | 12/2012 | Imai | C23C 2/26 148/284 |
| 2012/0328871 | A1 | 12/2012 | Rout et al. | |

FOREIGN PATENT DOCUMENTS

| | | | |
|---|---|---|---|
| EP | 2159292 A1 * | 3/2010 | C21D 1/18 |
| EP | 2 520 693 | 11/2012 | |
| GB | 1260659 | 1/1972 | |
| JP | 2010-242173 | 10/2010 | |
| JP | 2011-122240 | 6/2011 | |
| JP | 2013-503254 | 1/2013 | |
| RU | 2451107 | 8/2011 | |
| RU | 2010147375 | 5/2012 | |
| WO | WO 2008/153183 | 12/2008 | |
| WO | WO 2011/023418 A1 | 3/2011 | |
| WO | WO 2012/018014 A1 | 2/2012 | |

OTHER PUBLICATIONS

Fioravanti, K.J., et al., "Behavior of Galvalume Coated Sheet Steel at Elevated Temperatures in $O_2$ and $O_2/H_2O$ Atmospheres", Oxidation of Metals, 1984, vol. 21, No. 5, pp. 285-297.

Hornbogen, E., "Two Types of Discontinuous Precipitation in Alpha Iron Solid Solutions", Transactions of the Metallurgical Society of AIME, 227, Dec. 1963, pp. 1411-1418.

Jorgensen, P.J., "Effect of an Electric Field on the Oxidation of Zinc", Journal of the Electrochemical Society, 1963, vol. 110, No. 5, pp. 461-462.

Mackowiak, J., et al., "Metallurgy 0f galvanized coatings", International Metals Reviews, Review 237, 1979, No. 1, pp. 1-19.

Meussner, R.A., et al., "Oxidation and Self-Repair of the Zinc-Based High temperature Coating for Niobium", Corrosion Science 7.2 (1967), pp. 103-114.

Moore, W., "Oxidation of Metals at High Temperatures", Journal of the Electrochemical Society, 1953, vol. 100, No. 7, pp. 302-313.

Philliips, C.J., et al., "Porcelain Enameling of Galvannealed Steel", Final Report to the International Lead Zinc Research Organization, Jan. 1, 1963 to June 30, 1968.

Schlegel, C., et al.,"The Pemcoat Process: A New Process that Simplifies Direct Enameling", Ceramic Engineering and Science Proceedings, vol. 22, No. 5, 2001, pp. 125-136.

Schramm, J., "Röntgenographische Untersuchung der Phasen und Phasengrenzen in den Systemen des Zinks mit Eisen, Kobalt und Nickel", Zeitschrift für Metallkunde, 80. Jahrgang, Heft 4, Apr. 1938, pp. 122-130.

Sebisty, J.J., "Continuous-Strip Galvanized Coatings at Elevated Temperatures", Electrochemical Technology, 1968, vol. 6, No. 9-10, pp. 330-336.

Speich, G.R., "Cellular Precipitation in Fe—Zn Alloys", Transactions of the Metallurgical Society of AIME, 242, Jul. 1968, pp. 1359-1367.

Speich, G.R., et al., "The Lattice Parameter and Alpha Phase Boundary of Ferritic Iron-Zinc Alloys", Transactions of the Metallurgical Society of AIME, 230, Jun. 1954, pp. 939-940.

Su, X., et al., "Thermodynamic evaluation of the Fe—Zn system", Journal of Alloys and Compounds, 325 (2001), pp. 129-136.

Vernon, W.H.J., et al., "The Direct Oxidation of Zinc", Journal of the Institute of Metals, 1939, vol. 65, No. 2, pp. 301-343.

Australian Office Action dated Apr. 8, 2016 for Application No. AU 2014265241, 3 pgs.

International Search Report and Written Opinion dated Sep. 9, 2014 for Application No. PCT/US2014/038467, 11 pgs.

Taiwanese Office Action dated Nov. 9, 2015 for Application No. TW 103117385, 5 pgs.

Canadian Office Action dated Oct. 21, 2016 for Application No. 2,910,703, 3 pgs.

Chinese Office Action dated Oct. 8, 2016 for Application No. 201480028556.X, 11 pgs.

European Communication dated Sep. 12, 2016 for Application No. 14730045.3, 5 pgs.

Korean Office Action dated Nov. 14, 2016 for Application No. 10-2015-7035339, 8 pgs.

Canadian Office Action dated May 16, 2017 for Application No. 2,910,703, 3 pgs.

Chinese Office Action dated Jul. 31, 2018 for Application No. 201710513551.1, 16 pgs.

(56) References Cited

OTHER PUBLICATIONS

European Communication dated Jul. 26, 2017 for Application No. 14730045.3, 5 pgs.
Japanese Office Action dated May 29, 2018 for Application No. 2016-514142, 13 pgs.
Korean Office Action dated Mar. 24, 2017 for Application No. 10-2015-7035339, 5 pgs.
Korean Office Action dated Jul. 11, 2017 for Application No. 10-2015-7035339, 4 pgs.
Russian Office Action dated Mar. 21, 2018 for Application No. 2015146678, 14 pgs.
Taiwanese Office Action dated Apr. 7, 2017 for Application No. 105132804, 10 pgs.
Chinese Office Action dated Mar. 8, 2019 for Application No. 201710513551.1, 16 pgs.
Indian Office Action dated May 8, 2019 for Application No. 10351/DELNP/2015, 6 pgs.
Russian Office Action dated Jun. 14, 2019 for Application No. 2018134251, 16 pages.

* cited by examiner

ZINC-COATED STEEL FOR PRESS HARDENING APPLICATIONS AND METHOD OF PRODUCTION

CROSS REFERENCE TO RELATED APPLICATIONS

The present application hereby claims the benefit of the provisional patent application of the same title, U.S. Ser. No. 61/824,791, filed on May 17, 2013, the disclosure of which is hereby incorporated by reference in its entirety.

BACKGROUND

Press hardened steels are typically high strength and have been used in automotive applications for reducing weight while improving safety performance. Hot stamped parts have mainly been made from either bare steel, which must have the oxide removed after stamping, or from steel with an aluminized coating. The aluminized coating provides a barrier form of corrosion protection. A zinc-based coating further provides hot stamped parts with active, or cathodic corrosion protection. For instance, hot dip galvanized steel typically includes a Zn—Al coating and hot dip galvannealed steel typically includes a Zn—Fe—Al coating. Due to the melting temperature of zinc, liquid zinc can be present during the hot stamping process and lead to cracking due to liquid metal embrittlement (LME). Time at the high temperature required for austenitization of the steel substrate prior to hot stamping allows for diffusion of iron into the galvannealed coating to avoid LME. However, during the time required to allow for sufficient iron diffusion, zinc in the coating can be lost due to vaporization and oxidation. This oxide may also exhibit poor adhesion and tend to flake off during stamping.

Disclosed herein is a pre-alloying heat treatment performed after galvannealing and prior to the hot stamping austenitization step. The pre-alloying allows for shorter time at the austenitization temperature to form a desired α-Fe phase in the coating by increasing the concentration of iron. This also decreases the loss of zinc, and a more adherent oxide exists after hot stamping.

BRIEF DESCRIPTION OF THE FIGURES

The accompanying drawings, which are incorporated in and constitute a part of this specification, illustrate embodiments, and together with the general description given above, and the detailed description of the embodiments given below, serve to explain the principles of the present disclosure.

DETAILED DESCRIPTION

Figure 1:
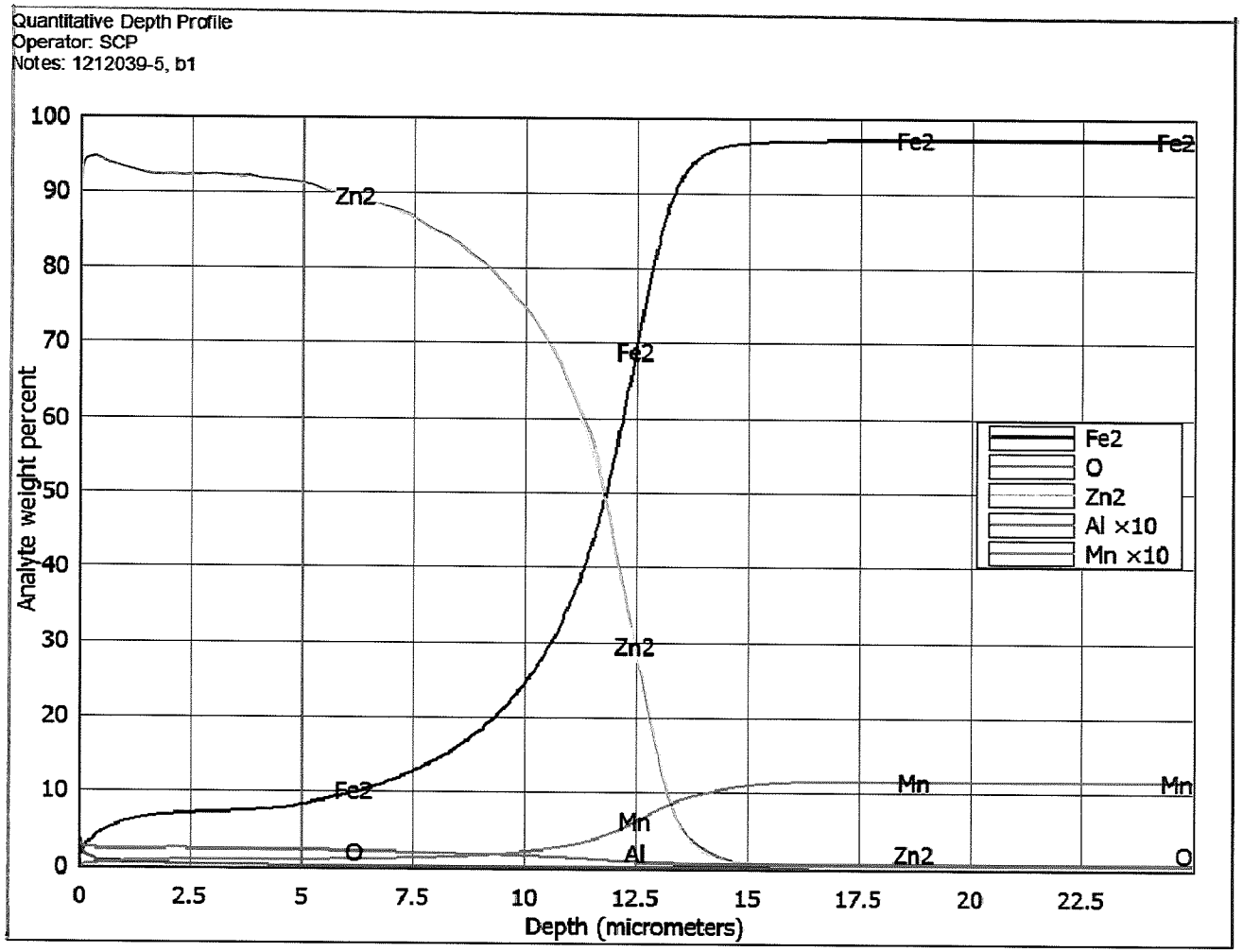
FIG. 1 depicts a graph of a glow discharge spectroscopy scan of a galvannealed steel sheet after a pre-alloying treatment of 0 hours, or "as-coated."

Press hardened steel can be formed from boron-containing steel, such as the 22MnB5 alloy. Such a 22MnB5 alloy typically comprises between about 0.20 and about 0.25 C, between about 1.0 and about 1.5 Mn, between about 0.1 and about 0.3 Si, between about 0.1 and about 0.2 Cr, and between about 0.0005 and about 0.005 B. As apparent to one with ordinary skill in the art in view of the teachings herein, other suitable alloys can be used. Other suitable alloys can include any suitable press hardenable alloys that include a sufficient hardenability to produce a desired combination of strength and ductility for hot stamping. For example, similar alloys typically used in automotive hot stamping applications can be used. The alloy is processed into a cold rolled steel strip by typical casting, hot rolling, pickling, and cold rolling processes.

The cold rolled steel strip is then hot dip galvannealed to produce a Zn—Fe—Al coating on the steel strip. The coating weight is typically in the range of about 40 to about 90 g/m2 per side. Temperatures of the galvannealing furnace range from about 900 to about 1200° F. (about 482 to about 649° C.) and result in Fe levels in the coating of about 5 to about 15 wt %. Aluminum levels in the zinc pot range from about 0.10 to about 0.20 wt %, with the analyzed Al level in the coating at typically double the amount in the pot. Other suitable methods for galvannealing the steel strip will be apparent to one with ordinary skill in the art in view of the teachings herein.

The steel strip possessing the galvannealed coating is then given a pre-alloying heat treatment designed to increase the Fe level in the coating to between about 15 and about 25 wt %. This heat treatment has a peak temperature of about 850 to about 950° F. (about 454 to about 510° C.) with a dwell time of about 1 to about 10 hours, such as about 2 to about 6 hours. The pre-alloying heat treatment can be conducted through an open coil annealing practice. The pre-alloying heat treatment can be further conducted in a protective atmosphere. Such a protective atmosphere can include a nitrogen atmosphere. In some versions, the nitrogen atmosphere includes about 100% $N_2$. In other versions, the nitrogen atmosphere includes about 95% $N_2$ and about 5% $H_2$. Other suitable methods for providing a pre-alloying heat treatment will be apparent to one with ordinary skill in the art in view of the teachings herein.

Once the galvannealed steel strip has been given the pre-alloying heat treatment, the steel strip is subjected to a hot stamping austenitization step. Hot stamping is well known in the art. Temperatures are typically in the range of about 1616 to about 1742° F. (about 880 to about 950° C.). Because of the pre-alloying heat treatment, time required at this austenitization temperature may be decreased. For instance, the time at the austenitization temperature can be between about 2 and about 10 minutes, or between about 4 and about 6 minutes. This forms a single phase α-Fe in the coating with approximately 30% Zn. Other suitable hot stamping methods will be apparent to one with ordinary skill in the art in view of the teachings herein.

EXAMPLES

A galvannealed steel coil was produced using the processes described above. A 22MnB5 steel coil was used having a thickness of about 1.5 mm. The galvannealed coating weight was about 55 g/m2. In this example, small panels of the galvannealed steel were given pre-alloy heat treatments in a nitrogen atmosphere at about 900° F. A first panel was not given the pre-alloy heat treatment, i.e., the pre-alloy treatment was for 0 hours, or "as-coated." A second panel was given the pre-alloy heat treatment for about 1 hour. A third panel was given the pre-alloy heat treatment for about 4 hours. The pre-alloyed panels were then austenitized at about 1650° F. for about 4 minutes and quenched between water cooled flat dies to simulate the hot stamping process.

Figure 2:
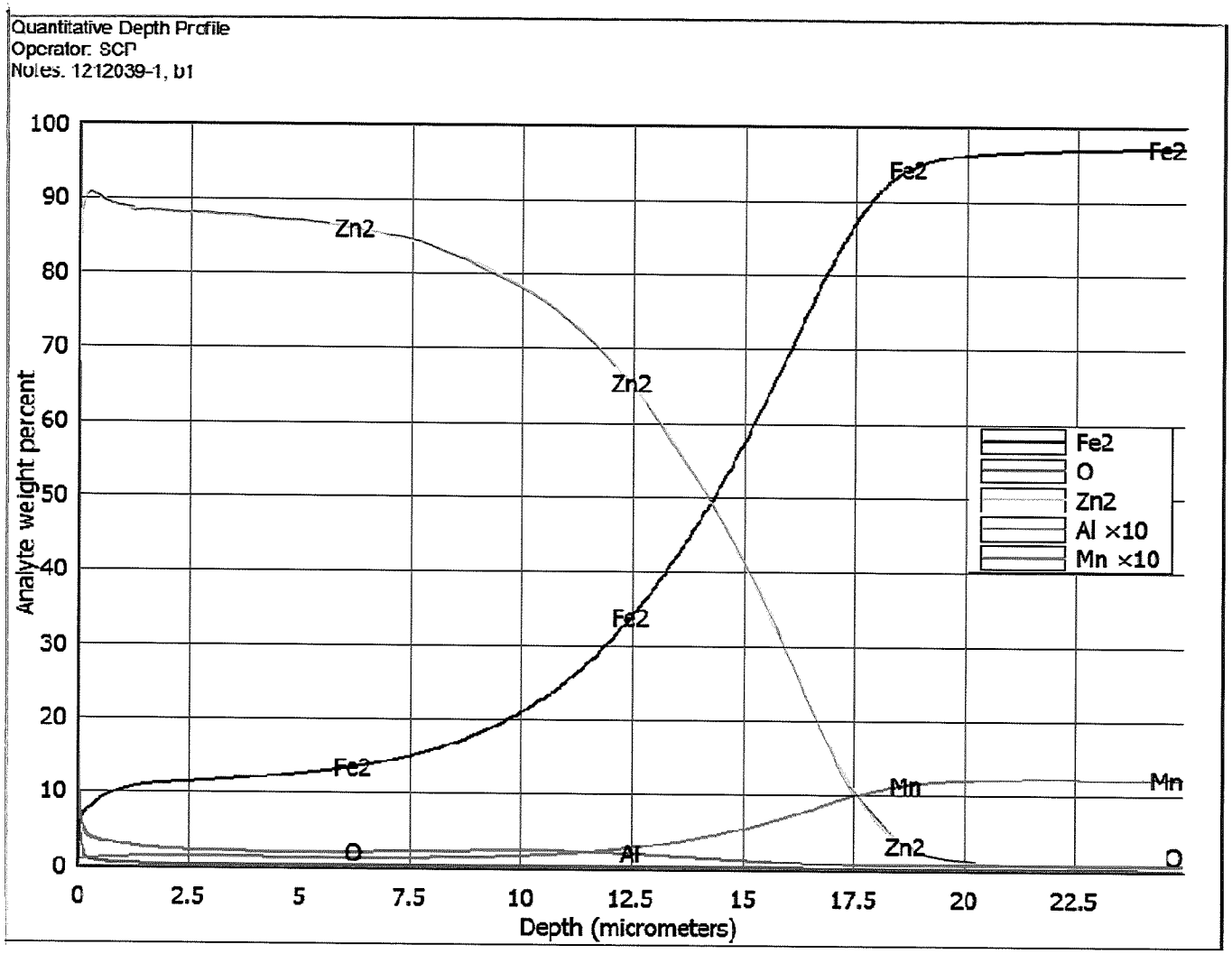
FIG. 2 depicts a graph of a glow discharge spectroscopy scan of a galvannealed steel sheet after a pre-alloying treatment of 1 hour.
Figure 3:
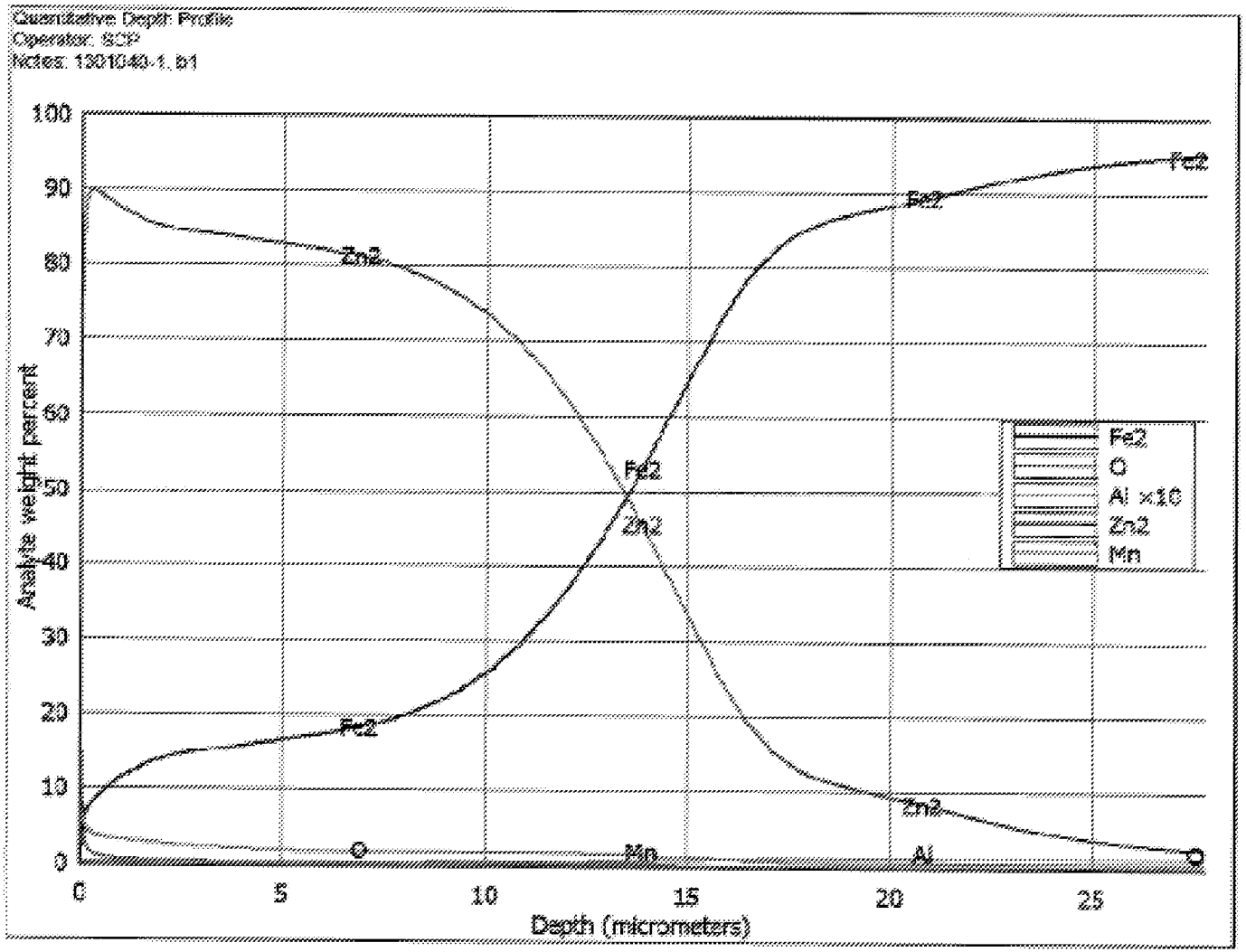
FIG. 3 depicts a graph of a glow discharge spectroscopy scan of a galvannealed steel sheet after a pre-alloying treatment of 4 hours.

The effect of the pre-alloying treatment was shown in glow discharge spectroscopy (GDS) scans, which show chemical composition through the thickness of the coating. The GDS scans after pre-alloying treatments for 0, 1, and 4 hours are shown in FIGS. 1-3 respectively. As shown, the Fe content in the coating increases with longer time at about 900° F.

Figure 4A:
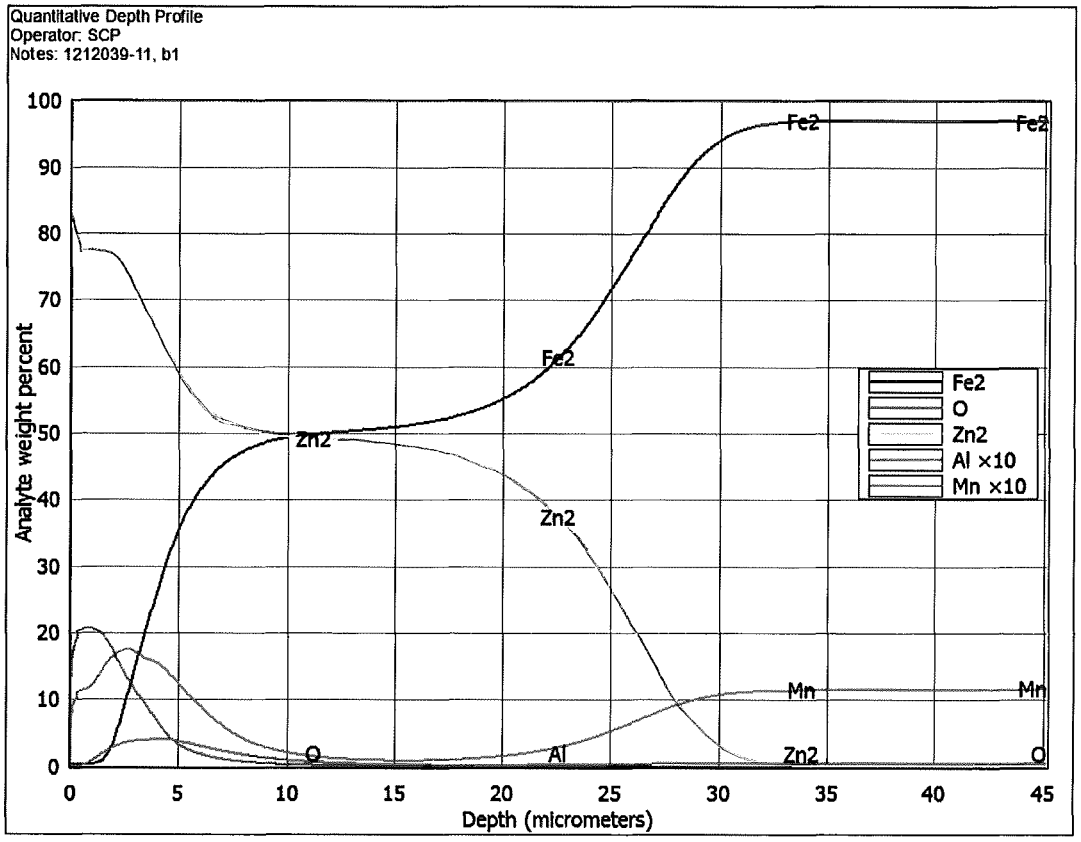
FIG. 4A depicts a graph of a glow discharge spectroscopy scan of the galvannealed steel sheet of FIG. 1 after hot stamping.
Figure 4B:
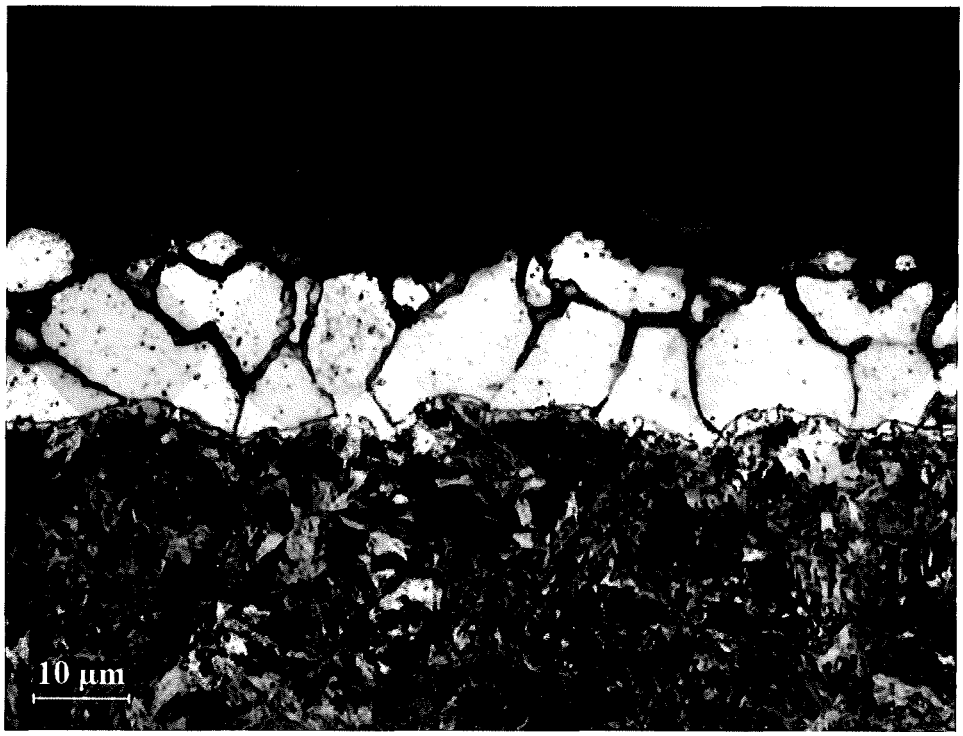
FIG. 4B depicts an optical micrograph of a cross-section of the galvannealed steel sheet of FIG. 4A.
Figure 5A:
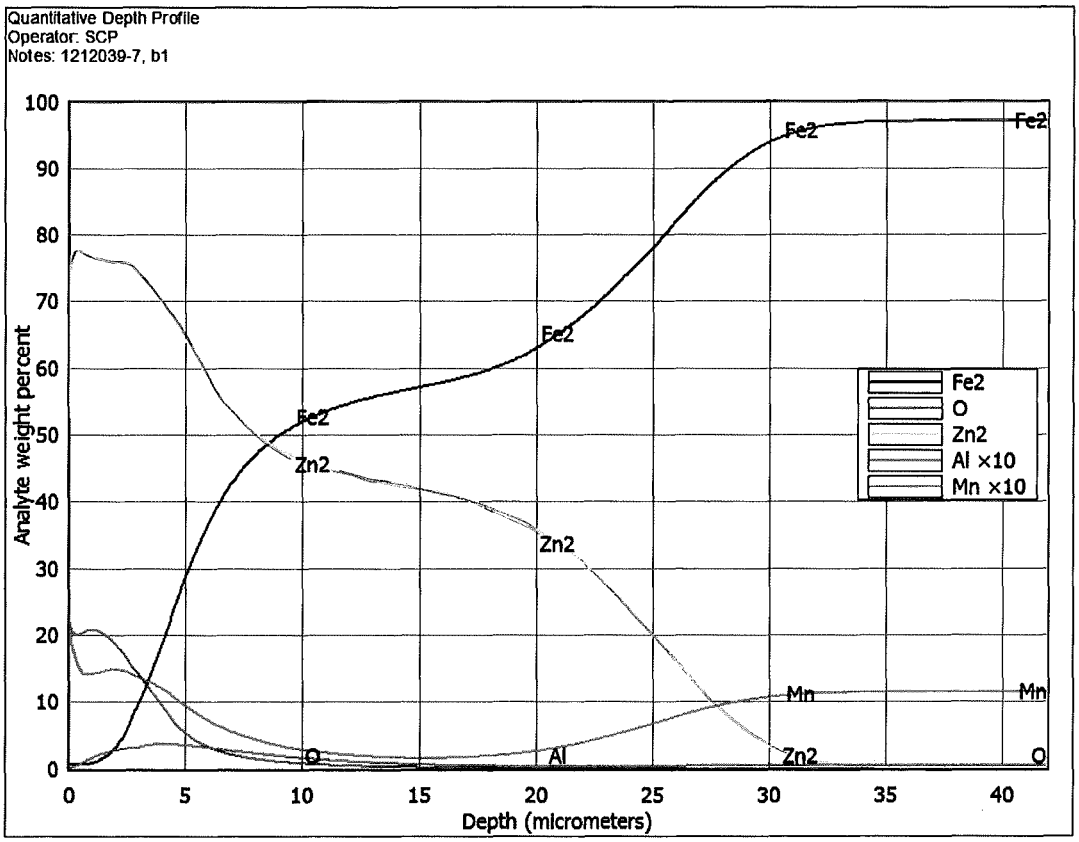
FIG. 5A depicts a graph of a glow discharge spectroscopy scan of the galvannealed steel sheet of FIG. 2 after hot stamping.
Figure 5B:
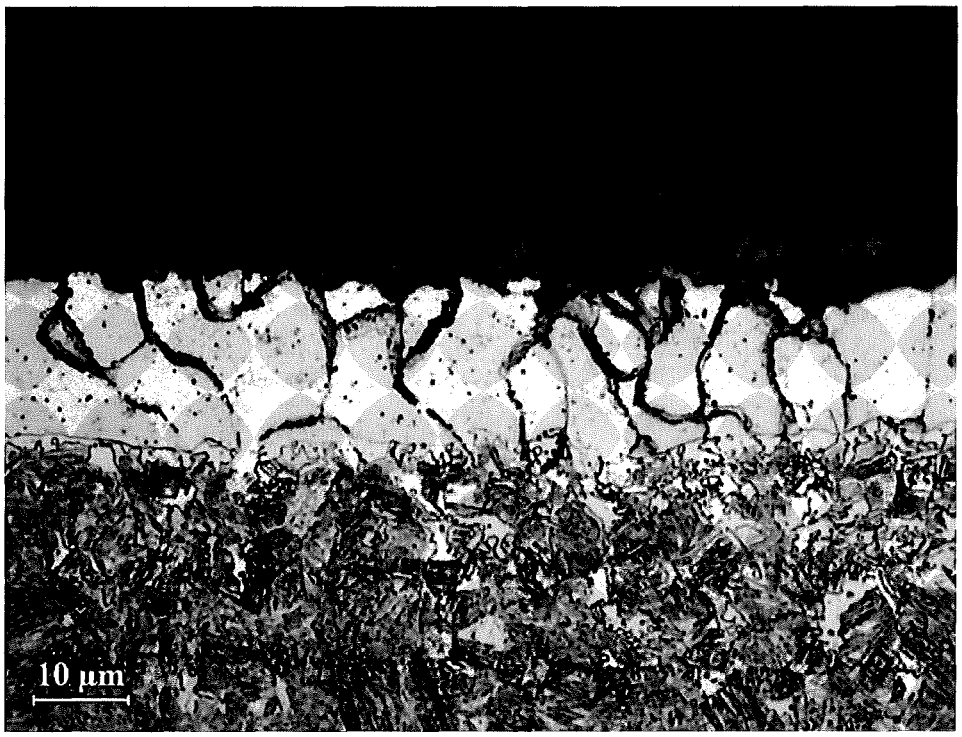
FIG. 5B depicts an optical micrograph of a cross-section of the galvannealed steel sheet of FIG. 5A.
Figure 6A:
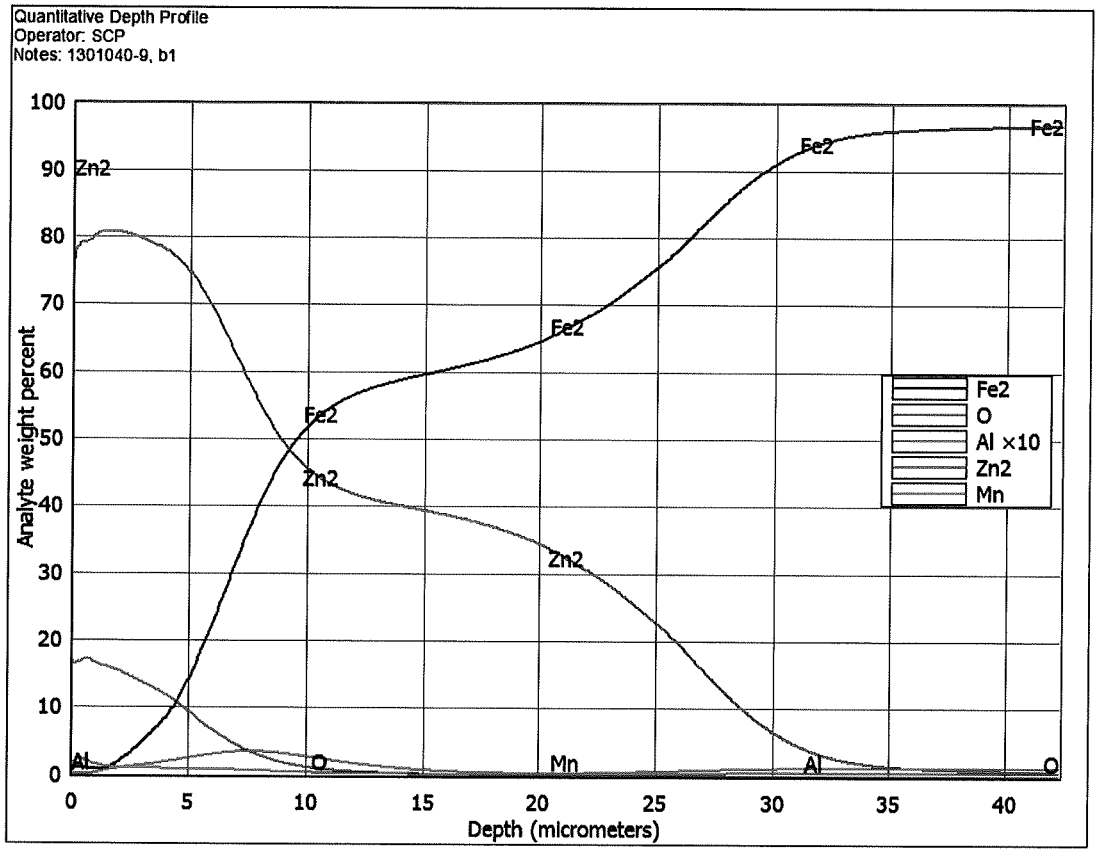
FIG. 6A depicts a graph of a glow discharge spectroscopy scan of the galvannealed steel sheet of FIG. 3 after hot stamping.
Figure 6B:
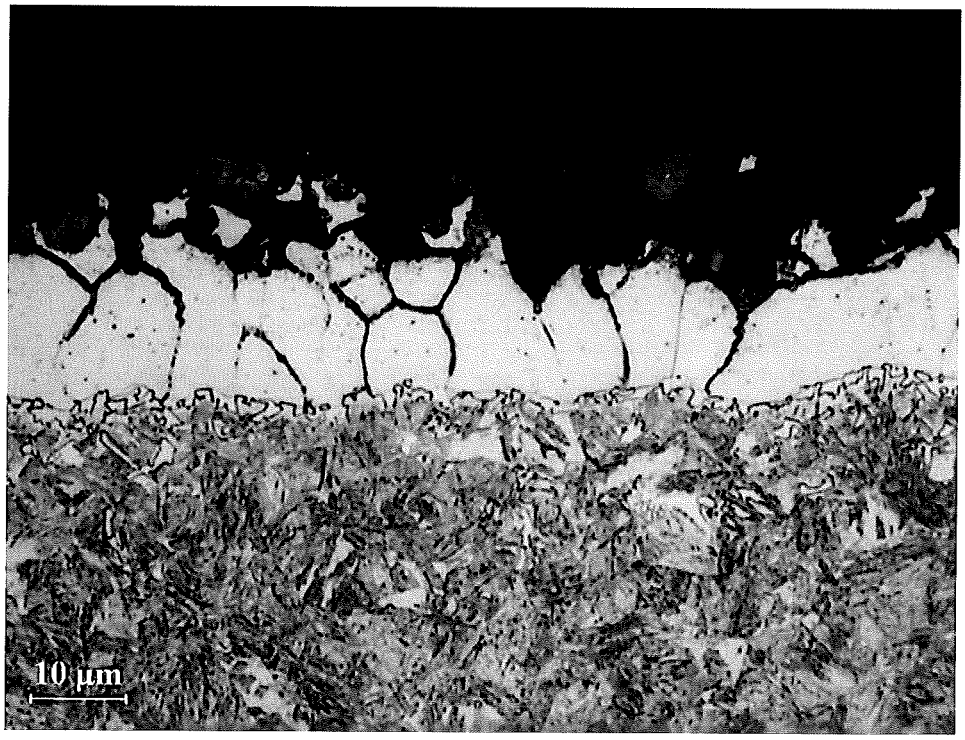
FIG. 6B depicts an optical micrograph of a cross-section of the galvannealed steel sheet of FIG. 6A.

FIGS. 4A, 5A, and 6A show GDS scans of the three panels, respectively, after hot stamping simulations. FIGS. 4B, 5B, and 6B show micrographs of the microstructures of the three panels, respectively, after hot stamping simulations. As length of the pre-alloy treatment time increases from 0 to 1 to 4 hours, the content of Fe in the coating increases. The micrographs indicate that as the % Fe increases, gaps between grains in the coating decrease. The gaps between coating grains are indicative of liquid on the grain boundaries at high temperature, thereby showing that the pre-alloy heat treatment reduces the amount of liquid Zn present at the time of hot stamping. With the amount of liquid reduced, the potential for LME cracking is in turn reduced.

Figure 7:
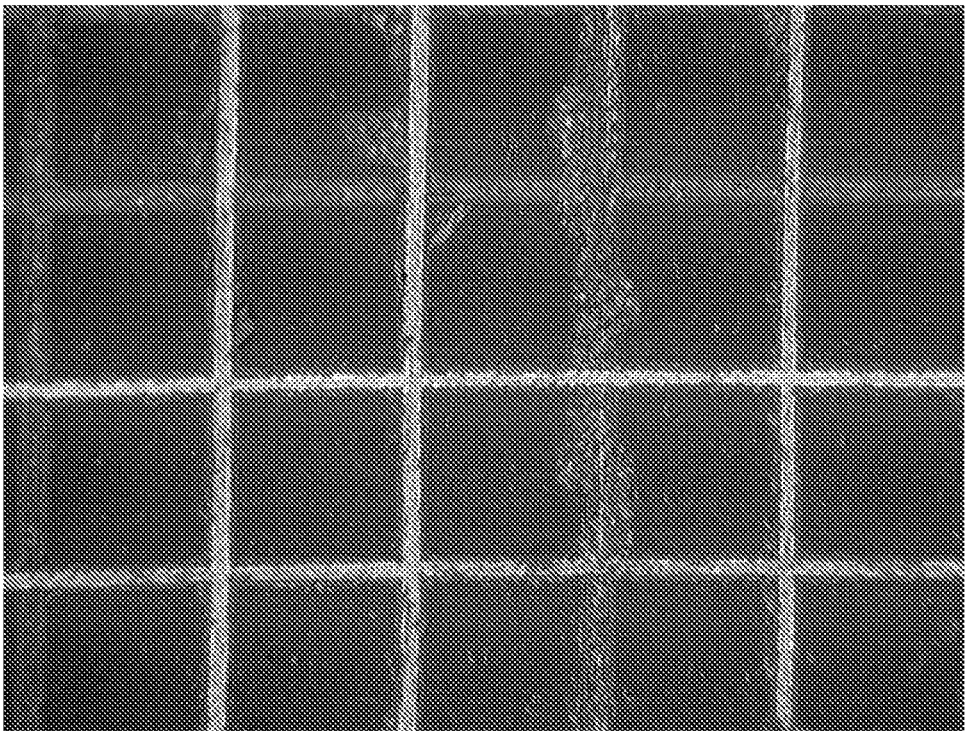
FIG. 7 depicts an optical micrograph of a galvannealed steel sheet processed according to the conditions of FIG. 4A, showing a cross-hatched area.
Figure 8:
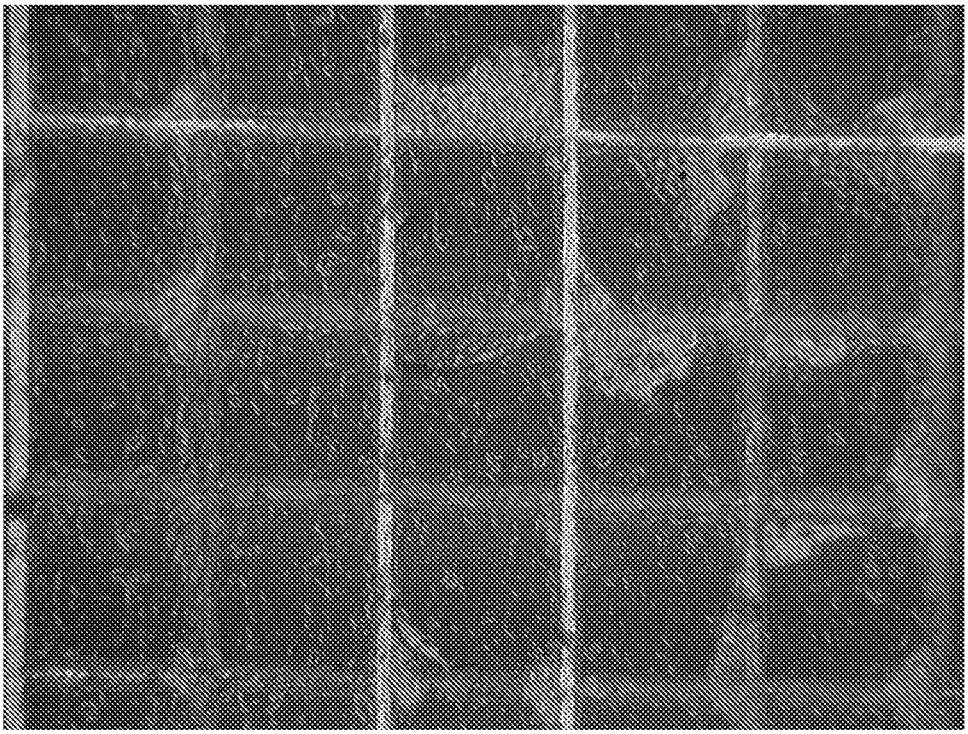
FIG. 8 depicts an optical micrograph of a galvannealed steel sheet processed according to the conditions of FIG. 5A, showing a cross-hatched area.
Figure 9:
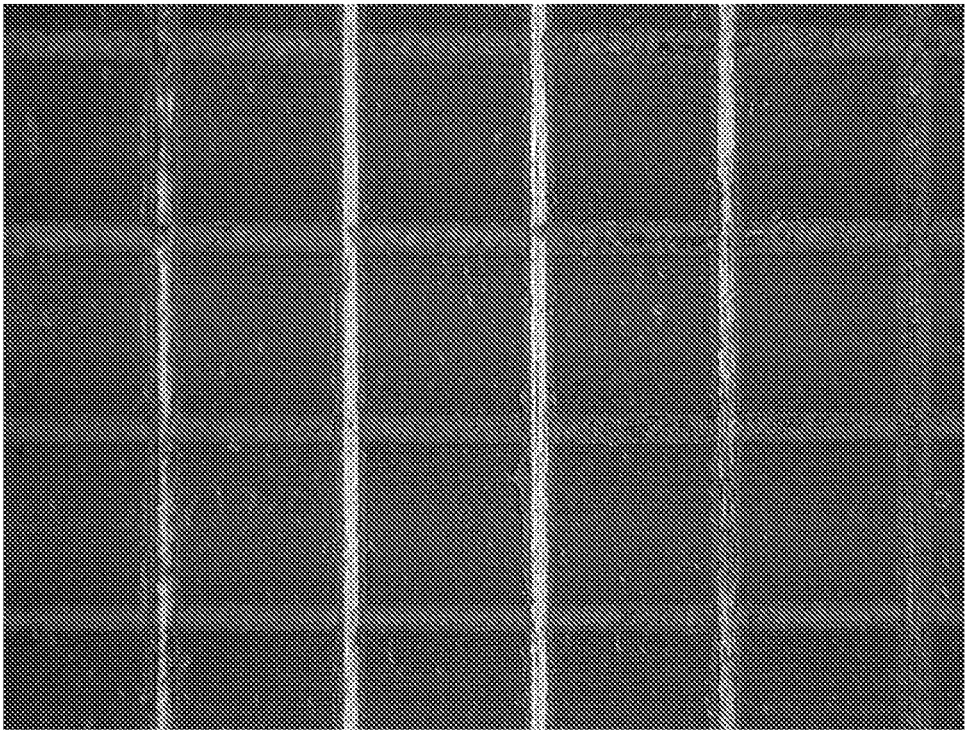
FIG. 9 depicts an optical micrograph of a galvannealed steel sheet processed according to the conditions of FIG. 6A, showing a cross-hatched area.

Zinc oxide formed during the austenitization treatment can be prone to flaking during hot stamping due to poor adhesion to the coating. Performing the pre-alloying heat treatment prior to austenitization and hot stamping can result in a more adherent oxide resistant to flaking. To measure this effect, panels processed according to the conditions described above, with pre-alloying times of about 0, 1, and 4 hours, were phosphated and e-coated in a laboratory system. The coated panels were given a cross-hatch and tape-pull test to test adherence. FIGS. 7-9 show micrographs of the cross-hatched areas of the three panels, respectively. As shown in FIGS. 7 and 8, panels with about 0 and 1 hour pre-alloying heat treatments show lower adhesion with loss of coating from squares within the cross-hatches. FIG. 9 shows that the panel with about 4 hours of the pre-alloying treatment shows increased adhesion with little to no loss of coating from squares within the cross-hatches.

While the present disclosure has illustrated by description several embodiments and while the illustrative embodiments have been described in considerable detail, it is not the intention of the applicant to restrict or in any way limit the scope of the appended claims to such detail. Additional advantages and modifications may readily appear to those skilled in the art.

What is claimed is:

1. A method of producing steel, the method comprising the steps of:

galvannealing the steel to form a coating comprising Zn—Fe—Al on the steel, wherein the step of galvannealing includes heating in a galvannealing furnace at a temperature of 900 to 1200° F.;

pre-alloying said galvannealed coating to increase the Fe content in the coating, without any additional coating step, using a pre-alloying heat treatment, the pre-alloying heat treatment is conducted at a temperature between about 850° F. and about 950° F. prior to hot stamping, wherein the steel is subject to the pre-alloying heat treatment for a treatment time, wherein the pre-alloying heat treatment is performed using an open coil annealing process with a dwell time of about 2 hours or more while the galvannealed coating is in an as-coated condition; and determining the treatment time of the pre-alloying heat treatment such that the Fe content in the coating is between 15 wt % and 25 wt % after the pre-alloying heat treatment.

2. The method of claim 1, wherein the coating weight is in the range of about 40 to about 90 g/m$^2$ per side.

3. The method of claim 1, wherein the treatment time of the pre-alloying heat treatment is between about 2 hours and about 6 hours.

4. The method of claim 1, wherein the pre-alloying heat treatment is conducted in a protective atmosphere.

5. The method of claim 4, wherein the protective atmosphere comprises nitrogen.

6. The method of claim 5, wherein the protective atmosphere comprises about 100 vol % $N_2$.

7. The method of claim 5, wherein the protective atmosphere further comprises hydrogen.

8. The method of claim 7, wherein the protective atmosphere comprises about 95 vol % $N_2$ and about 5 vol $H_2$.

9. The method of claim 1 further comprising hot stamping the steel after the pre-alloying heat treatment.

10. The method of claim 9, wherein the hot stamping step comprises an austenitizing step, wherein the austenitizing step comprises heating the steel to a temperature between about 1616° F. and about 1742° F.

11. The method of claim 9, wherein the hot stamping step comprises an austenitizing step, wherein the austenitizing step proceeds for a predetermined duration, wherein the predetermined duration comprises a time between about 2 minutes and about 10 minutes.

12. The method of claim 9, further determining the treatment time of the pre-alloying heat treatment such that the coating comprises solid solution α-Fe with up to approximately 30 wt % Zn after hot stamping.

* * * * *